US011448214B2

(12) United States Patent
Kim et al.

(10) Patent No.: US 11,448,214 B2
(45) Date of Patent: Sep. 20, 2022

(54) COMPRESSOR INCLUDING A HEAT RADIATING MEMBER

(71) Applicant: LG Electronics Inc., Seoul (KR)

(72) Inventors: Taekyoung Kim, Seoul (KR); Kangwook Lee, Seoul (KR); Nayoung Jeon, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 17/185,392

(22) Filed: Feb. 25, 2021

(65) Prior Publication Data

US 2021/0277892 A1 Sep. 9, 2021

(30) Foreign Application Priority Data

Mar. 6, 2020 (KR) ..... 10-2020-0028405

(51) Int. Cl.
*F04C 18/02* (2006.01)
*F04C 2/02* (2006.01)
(Continued)

(52) U.S. Cl.
CPC ..... *F04C 18/0215* (2013.01); *F04C 2/025* (2013.01); *F04C 23/008* (2013.01);
(Continued)

(58) Field of Classification Search
CPC ..... F04C 2/025; F04C 18/0207–0292; F04C 15/0088–0092; F04C 29/02–028;
(Continued)

(56) References Cited

U.S. PATENT DOCUMENTS 1,897,907 A * 2/1933 Karge ..... F25B 1/005 62/468
3,134,369 A * 5/1964 Karl ..... F04C 29/04 418/101
(Continued)

FOREIGN PATENT DOCUMENTS

JP 63100285 A * 5/1988
JP 5889405 3/2016
(Continued)

OTHER PUBLICATIONS

Office Action in Korean Appln. No. 10-2020-0028405, dated Jul. 2, 2021, 9 pages (with English translation).

*Primary Examiner* — Laert Dounis
(74) *Attorney, Agent, or Firm* — Fish & Richardson P.C.

(57) ABSTRACT

A compressor includes a casing that defines an oil storage space and an opening that discharges refrigerant to an outside of the casing, a rotatable shaft disposed in the casing, a driver coupled to an inner circumferential surface of the casing and configured to rotate the rotatable shaft, a compression assembly coupled to the rotatable shaft and configured to compress and discharge the refrigerant to an inside of the casing, a muffler coupled to the compression assembly and configured to guide the refrigerant discharged from the compression assembly toward the opening, where the muffler being is configured to exchange heat with the refrigerant, and a heat radiating member that is coupled to the muffler and extends to the oil storage space and contacts the oil in the oil storage space. The muffler is configured to exchange heat with the oil through the heat radiating member.

20 Claims, 9 Drawing Sheets

(51) Int. Cl.

| | |
|---|---|
| ***F04C 29/06*** | (2006.01) |
| ***F04C 29/02*** | (2006.01) |
| ***F04C 29/04*** | (2006.01) |
| ***F04C 23/00*** | (2006.01) |

(52) U.S. Cl.
CPC ..... *F04C 29/02* (2013.01); *F04C 29/028* (2013.01); *F04C 29/04* (2013.01); *F04C 29/065* (2013.01); *F04C 2240/30* (2013.01); *F04C 2240/60* (2013.01)

(58) Field of Classification Search
CPC ..... F04C 15/0096; F04C 29/04–047; F01C 1/0207–0292; F01C 21/04–045; F01C 21/06
See application file for complete search history.

(56) References Cited

U.S. PATENT DOCUMENTS

| | | | | |
|---|---|---|---|---|
| 6,658,885 | B1 * | 12/2003 | Zhou | F04C 29/02 62/472 |
| 9,677,401 | B1 * | 6/2017 | Alsubaih | F01C 21/08 |
| 2005/0281691 | A1 * | 12/2005 | Lee | F04B 35/045 417/415 |
| 2015/0184539 | A1 * | 7/2015 | Maier | B23P 15/26 29/890.035 |
| 2020/0032803 | A1 * | 1/2020 | Lee | F04C 29/12 |

FOREIGN PATENT DOCUMENTS

| | | |
|---|---|---|
| KR | 1020050121053 | 12/2005 |
| KR | 10-2006-0119318 | 11/2006 |

* cited by examiner

COMPRESSOR INCLUDING A HEAT RADIATING MEMBER

CROSS-REFERENCE TO RELATED APPLICATIONS

This application claims the benefit of Korean Patent Application No. 10-2020-0028405, filed on Mar. 6, 2020, which is hereby incorporated by reference as when fully set forth herein.

TECHNICAL FIELD

The present disclosure relates to a compressor. More specifically, the present disclosure relates to a compressor including a heat radiating member for increasing a temperature of oil circulating inside the compressor to lubricate the compressor.

BACKGROUND

A compressor may be part of an apparatus running a refrigeration cycle such as a refrigerator or an air conditioner. For example, the compressor may compress refrigerant to provide work to generate heat exchange in the refrigeration cycle.

In some cases, the compressors may be classified into a reciprocating type, a rotary type, and a scroll type based on a scheme in which the refrigerant is compressed. A scroll type compressor among the various types of compressors may include an orbiting scroll that is engaged with a fixed scroll and orbits around the fixed scroll fixed scroll fixedly disposed in an internal space of a casing. The scroll type compressor may include a compression chamber defined between a fixed wrap of the fixed scroll and an orbiting wrap of the orbiting scroll.

In some cases, compared with other types of the compressors, the scroll type compressor may obtain a relatively high compression ratio because the refrigerant is continuously compressed through the scrolls engaged with each other, and may obtain a stable torque because suction, compression, and discharge cycles of the refrigerant proceed continuously. For this reason, the scroll type compressor may be used for compressing the refrigerant in the air conditioner and the like.

In some cases, a scroll type compressor may include a rotatable shaft that is eccentrically arranged in a radial direction. For example, the orbiting scroll may be fixed to the eccentric rotatable shaft and configured to orbit around the fixed scroll. As a result, the orbiting scroll may orbit around the fixed wrap of the fixed scroll to compress the refrigerant.

In some cases, the scroll compressor may include a compression assembly disposed under a refrigerant discharger, and a driver disposed under the compression assembly. One end of the rotatable shaft may be coupled to the compression assembly, while the other end thereof may extend in a direction away from the refrigerant discharger and be coupled to the driver. The compression assembly may be located closer to the refrigerant discharger than the driver is (or the compression assembly is disposed above the driver), and there may be difficulty in supplying oil to the compression assembly. Further, an additional lower frame under the driver may separately support the rotatable shaft connected to the compression assembly. Further, action points of a gas force generated via the compression of the refrigerant and a reaction force supporting the gas force may not coincide with each other within the compression assembly, which may lead to tiling of the orbiting scroll and decrease reliability.

In some cases, a scroll compressor (referred to as a lower scroll compressor) may include a driver that is located closer to the refrigerant discharger than the compression assembly is while the driver is disposed between the refrigerant discharger and the compression assembly.

In the lower scroll compressor, since a distal end of the rotatable shaft may be located far from the refrigerant discharger and rotatably supported by the compression assembly, a lower frame may be omitted. Further, the oil stored in a lower portion of the casing may be directly supplied to the compression assembly without passing through the driver, such that lubrication of the fixed scroll and the orbiting scroll can be performed quickly. Furthermore, when the rotatable shaft passes through the fixed scroll in the lower scroll compressor, the points of action of the gas force and the reaction force coincide with each other at the rotatable shaft, such that an upsetting moment of the orbiting scroll may be fundamentally removed.

In some cases of the lower scroll compressor, the driver may be located closer to the refrigerant discharger than the compression assembly is while the driver is disposed between the refrigerant discharger and the compression assembly. The orbiting scroll may be located adjacent to the refrigerant discharger, and the fixed scroll may be located farther from the refrigerant discharger than the orbiting scroll is. Since the refrigerant compressed in the compression assembly is discharged through the fixed scroll, the refrigerant may be discharged from the compression assembly in a direction away from the refrigerant discharger.

In some cases, the lower scroll compressor may additionally include a muffler coupled to the fixed scroll while the fixed scroll is disposed between the refrigerant discharger and the muffler. The muffler may guide the refrigerant discharged from the fixed scroll to the driver and the refrigerant discharger. The muffler may define a space in which the refrigerant discharged from the compression assembly may change a flow direction thereof.

In some cases, the muffler may prevent or block the refrigerant discharged from the compression assembly from colliding with the oil stored in the casing, and may guide high-pressure refrigerant smoothly to the refrigerant discharger.

In some cases, when the lower scroll compressor initially operates or operates after having been left at a low temperature, a temperature of the oil may be low, which may cause bearing damage and a decline of an oil level.

In some cases, the temperature of oil may be controlled by exchanging the oil that lubricates components of the compressor with the refrigerant.

For example, the oil may lubricate the components of the compressor and exchange heat with refrigerant flowing into the compressor or refrigerant discharged from the compressor. That is, when the temperature of the oil needs to be raised, the oil may exchange heat with the refrigerant discharged from the compressor. When the temperature of the oil needs to be lowered, the oil may exchange heat with the refrigerant flowing into the compressor.

In some cases, a flow rate of the refrigerant flowing in the compressor may directly relate to efficiency of an air conditioner or system including the compressor, and a separate component outside the compressor may be added to branch the refrigerant.

SUMMARY

The present disclosure describes a compressor having a structure that can help to raise a temperature of oil flowing in the compressor.

The present disclosure describes a compressor having a structure that can increase the temperature of the oil flowing in the compressor without changing a flow rate of refrigerant flowing in the compressor.

The present disclosure describes a compressor having a structure that can increase the temperature of the oil flowing in the compressor without installing a separate component outside the compressor.

The present disclosure further describes a compressor having a structure that can increase the temperature of the oil flowing in the compressor when the compressor starts for the first time or when the compressor has been left at a low temperature and then starts.

The present disclosure further describes a compressor having a structure that can improve reliability of components included in the compressor.

According to one aspect of the subject matter described in this application, a compressor includes a casing that defines an oil storage space configured to receive oil therein and an opening that is configured to discharge refrigerant to an outside of the casing, a rotatable shaft disposed in the casing, a driver coupled to an inner circumferential surface of the casing and configured to rotate the rotatable shaft, a compression assembly coupled to the rotatable shaft and configured to compress and discharge the refrigerant to an inside of the casing, a muffler coupled to the compression assembly and configured to guide the refrigerant discharged from the compression assembly toward the opening, where the muffler is configured to exchange heat with the refrigerant, and a heat radiating member coupled to the muffler. The heat radiating member extends to the oil storage space and contact the oil in the oil storage space, and the muffler is configured to exchange heat with the oil through the heat radiating member.

Implementations according to this aspect can include one or more of the following features. For example, the heat radiating member can include a contact portion that is in contact with the muffler, and a heat radiating portion that extends from the contact portion to the oil storage space and contacts the oil in the oil storage space. In some examples, the heat radiating member can further include a fastener that couples the contact portion to the muffler. In some examples, the muffler can define a muffler shaft receiving portion through which the rotatable shaft passes, where a distance between the heat radiating portion and the muffler shaft receiving portion is less than a distance between the muffler shaft receiving portion and the fastener.

In some implementations, the heat radiating portion can have a tapered shape that extends toward the oil storage space and have a distal end located in the oil storage space. In some examples, the contact portion can define a first area in contact with the muffler and a second area connected to the heat radiating portion, where the second area is smaller than the first area. In some implementations, the contact portion extends in a radial direction of the rotatable shaft, and the contact portion has a first end that is located away from the muffler shaft receiving portion in the radial direction of the rotatable shaft, and a second end that faces the muffler shaft receiving portion in the radial direction of the rotatable shaft. The heat radiating portion can extend from the second end to the oil storage space.

In some implementations, the heat radiating portion can extend parallel to a longitudinal direction of the rotatable shaft. In some examples, the heat radiating member can be made of aluminum.

In some implementations, the muffler can define a muffler shaft receiving portion through which the rotatable shaft passes, and the heat radiating portion can include a first heat radiating portion that is spaced apart from the muffler shaft receiving portion by a first spacing, the first heat radiating portion surrounding at least a portion of the muffler shaft receiving portion, and a second heat radiating portion that surrounds at least a portion of the muffler shaft receiving portion, the second heat radiating portion being spaced apart from the muffler shaft receiving portion by a second spacing that is larger than the first spacing.

In some examples, a first extension length of the first heat radiating portion toward the oil storage space can be greater than a second extension of the second heat radiating portion toward the oil storage space. In some examples, the heat radiating portion defines at least one communication opening configured to communicate an outside of the heat radiating portion and an inside of the heat radiating portion with each other.

In some implementations, the first heat radiating portion can define a first communication opening configured to communicate an inside of the first heat radiating portion and an outside of the first heat radiating portion with each other, and the second heat radiating portion defines a second communication opening configured to communicate an inside of the second heat radiating portion and an outside of the second heat radiating portion with each other. In some examples, the first communication opening and the second communication opening face each other. For example, the first communication opening faces the second heat radiating portion, and the second communication opening faces the first heat radiating portion.

In some implementations, the contact portion can include a first contact portion in contact with the first heat radiating portion, a second contact portion in contact with the second heat radiating portion, and a third contact portion that extends between the first contact portion and the second contact portion. In some examples, the contact portion can further include a fourth contact portion that extends radially outward from the second contact portion.

In some implementations, the second heat radiating portion can surround at least a portion of the first heat radiating portion. In some implementations, the first heat radiating portion can include a pair of first heat radiating portions that are spaced apart from each other in a circumferential direction and arranged outside the muffler shaft receiving portion in a radial direction. The second heat radiating portion can include a pair of second heat radiating portions that are spaced apart from each other in the circumferential direction and arranged outside the pair of first heat radiating portions in the radial direction.

In some implementations, the driver can include a rotor coupled to the rotatable shaft and a stator coupled to the inner circumferential surface of the casing. The compression assembly can include a fixed scroll and an orbiting scroll, where the orbiting scroll is configured to rotate relative to the fixed scroll. The driver and the compression assembly can be arranged between the opening of the case and the oil storage space along the rotatable shaft.

In some implementations, the temperature of the oil flowing in the compressor can be raised using the internal component of the compressor.

Ins some implementations, the component for raising the temperature of oil flowing in the compressor can be manufactured and installed in a simpler manner.

In some implementations, the temperature of the oil flowing in the compressor can be raised without changing the flow rate of the refrigerant flowing in the compressor.

In some implementations, the reliability of the components included in the compressor can be improved.

DETAILED DESCRIPTIONS

For simplicity and clarity of illustration, elements in the figures are not necessarily drawn to scale. The same reference numbers in different figures denote the same or similar elements, and as such perform similar functionality. Furthermore, in the following detailed description of the present disclosure, numerous specific details are set forth in order to provide a thorough understanding of the present disclosure. However, it will be understood that the present disclosure can be practiced without these specific details. In other instances, well-known methods, procedures, components, and circuits have not been described in detail so as not to unnecessarily obscure aspects of the present disclosure.

Figure 1:
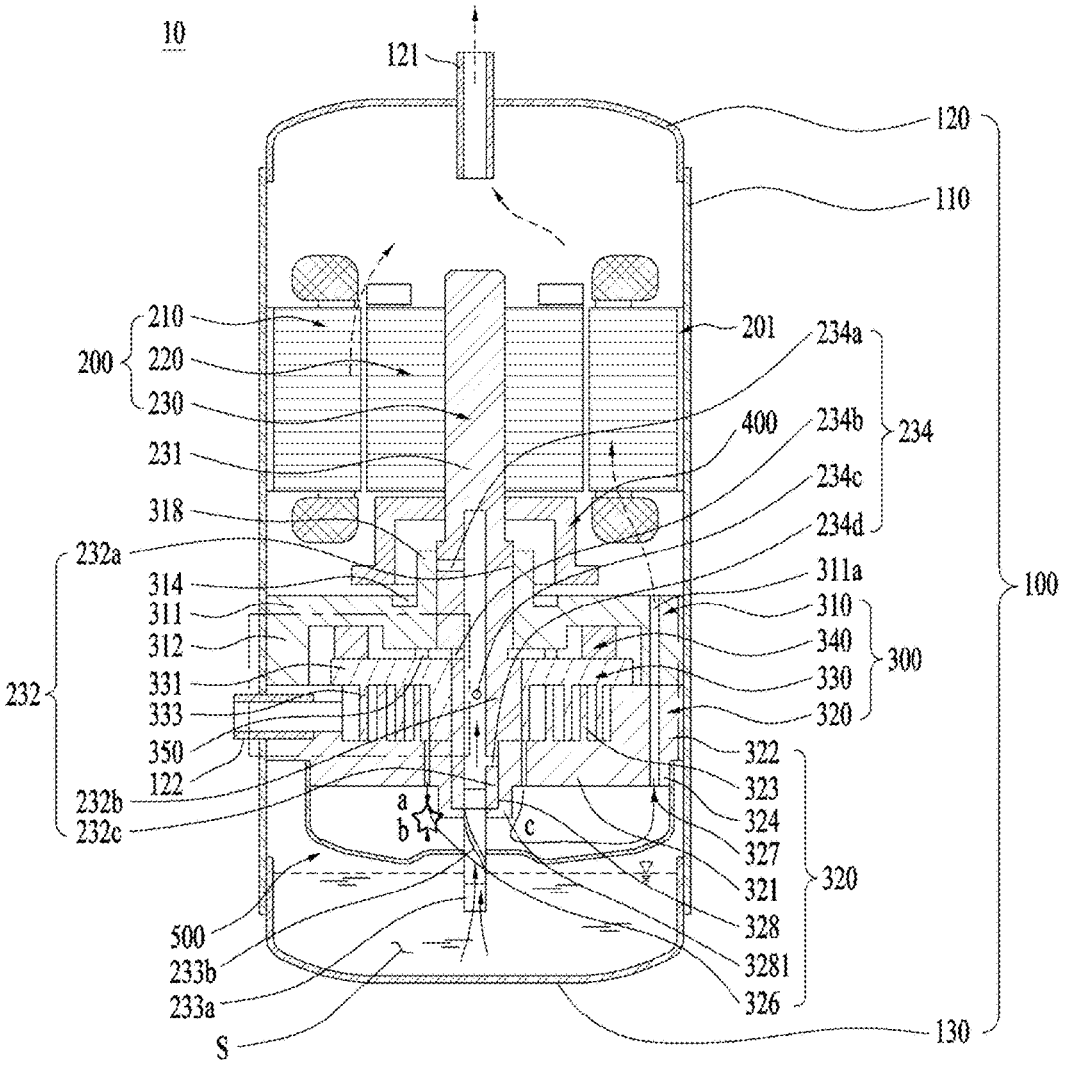
FIG. 1 is a diagram showing an example of a lower scroll compressor.

FIG. 1 is a diagram showing an example structure of a lower scroll compressor 10.

Referring to FIG. 1, the lower scroll compressor 10 can include a casing 100 having therein a space in which fluid is stored or flows, a driver 200 coupled to an inner circumferential surface of the casing 100 and configured to rotate a rotatable shaft 230, and a compression assembly 300 coupled to the rotatable shaft 230 inside the casing and compressing the fluid.

In some implementations, the casing 100 can include a refrigerant inlet 122 into which refrigerant is introduced and a refrigerant discharger 121 through which the refrigerant is discharged. The casing 100 can include a receiving shell 110 having a cylindrical shape and receiving the driver 200 and the compression assembly 300 therein, and having the refrigerant inlet 122, a discharge shell 120 coupled to one end of the receiving shell 110 and having the refrigerant discharger 121, and a sealing shell 130 coupled to the other end of the receiving shell 110 to seal the receiving shell 110. For example, the refrigerant discharger 121 can be an opening, a tube, a pipe, a port, or the like that can discharge the refrigerator from an interior of the casing 100.

The driver 200 includes a stator 210 for generating a rotating magnetic field, and a rotor 220 disposed to rotate by the rotating magnetic field. The rotatable shaft 230 can be coupled to the rotor 220 to be rotated together with the rotation of the rotor 220.

The stator 210 has a plurality of slots defined in an inner circumferential face thereof along a circumferential direction and a coil is wound in and along the plurality of slots, thereby to generate a rotating magnetic field. The stator can be fixedly disposed on the inner circumferential face of the receiving shell 110. The rotor 220 can have a plurality of magnets (permanent magnets) received therein configured to react to the rotating magnetic field. The rotor 220 can be rotatably accommodated inside the stator 210. The rotatable shaft 230 passes through a center of the rotor 220 and coupled thereto, so that when the rotor 220 rotates using the rotating magnetic field, the shaft 230 rotates together with the rotation of the rotor 220.

The compression assembly 300 can include a fixed scroll 320 fixed to the inner circumferential face of the receiving shell 110. The driver 200 is disposed between the refrigerant discharger 121 and the fixed scroll 320. The compression assembly 300 can include an orbiting scroll 330 coupled to the rotatable shaft 230 and engaged with the fixed scroll 320 to define a compression chamber. The compression assembly 300 can include a main frame 310 seated on the fixed scroll 320 and receive therein the orbiting scroll 330.

The lower scroll compressor 10 has the driver 200 disposed between the refrigerant discharger 121 and the compression assembly 300. Thus, when the refrigerant discharger 121 is disposed at a top of the casing 100, the compression assembly 300 can be disposed below the driver 200, and the driver 200 can be disposed between the refrigerant discharger 121 and the compression assembly 300.

Thus, when oil is stored on a bottom face of the casing 100, the oil can be supplied directly to the compression assembly 300 without passing through the driver 200. In addition, since the rotatable shaft 230 is coupled to and supported by the compression assembly 300, a lower frame for supporting the rotatable shaft can be omitted.

In some examples, the lower scroll compressor 10 can be configured such that the rotatable shaft 230 penetrates not only the orbiting scroll 330 but also the fixed scroll 320 and is in face contact with both the orbiting scroll 330 and the fixed scroll 320.

As a result, an inflow force generated when the fluid such as the refrigerant is flowed into the compression assembly 300, a gas force generated when the refrigerant is compressed in the compression assembly 300, and a reaction force for supporting the same can be exerted on the rotatable shaft 230 at the same time. Accordingly, the inflow force, the gas force, and the reaction force can be concentrated on the rotatable shaft 230. As a result, since an upsetting moment may not act on the orbiting scroll 320 coupled to the rotatable shaft 230, tilting or upsetting of the orbiting scroll can be prevented. In other words, various tilting including tilting in an axial direction as occurring at the orbiting scroll 320 can be attenuated or prevented. As a result, noise and tilting generated at the lower scroll compressor 10 can be reduced or prevented.

In addition, in the lower scroll compressor 10, a back-pressure generated while the refrigerant is discharged to an outside of the compression assembly 300 is absorbed or supported by the rotatable shaft 230, so that a force (normal force) by which the orbiting scroll 330 and the fixed scroll 320 are in an excessively close contact state to each other in the axial direction can be reduced. As a result, a friction force between the orbiting scroll 330 and the fixed scroll 320 can be greatly reduced, such that durability of the compression assembly 300 can be improved.

In some examples, the main frame 310 can include a main end plate 311 disposed on one side of the driver 200 or below the driver 200, a main side plate 312 extending from an inner circumferential face of the main end plate 311 in a direction farther away from the driver 200 and seated on the fixed scroll 330, and a main shaft receiving portion 318 extending from the main end plate 311 to rotatably support the rotatable shaft 230.

A main hole 317 for guiding the refrigerant discharged from the fixed scroll 320 to the refrigerant discharger 121 can be further defined in the main end plate 311 or the main side plate 312.

The main end plate 311 can further include an oil pocket 314 that is engraved in an outer face of the main shaft receiving portion 318. The oil pocket 314 can be defined in an annular shape, and can be defined to be eccentric to the main shaft receiving portion 318. When the oil stored in the sealing shell 130 is transferred through the rotatable shaft 230 or the like, the oil pocket 314 can be defined such that the oil is supplied to a portion where the fixed scroll 320 and the orbiting scroll 330 are engaged with each other.

The fixed scroll 320 can include a fixed end plate 321 coupled to the receiving shell 110 to form the other face of the compression assembly 300 while the main end plate 311 is disposed between the driver 200 and the fixed end plate 321, a fixed side plate 322 extending from the fixed end plate 321 toward the refrigerant discharger 121 and being in contact with the main side plate 312, and a fixed wrap 323 disposed on an inner circumferential face of the fixed side plate 322 to define the compression chamber in which the refrigerant is compressed.

Further, the fixed scroll 320 can include a fixed through-hole 328 defined to penetrate the rotatable shaft 230, and a fixed shaft receiving portion 3281 extending from the fixed through-hole 328 such that the rotatable shaft is rotatably supported. The fixed shaft receiving portion 3331 can be disposed at a center of the fixed end plate 321.

A thickness of the fixed end plate 321 can be equal to a thickness of the fixed shaft receiving portion 3381. In this case, the fixed shaft receiving portion 3281 can be inserted into the fixed through-hole 328 instead of protruding from the fixed end plate 321.

The fixed side plate 322 can include an inflow hole 325 defined therein for flowing the refrigerant into the fixed wrap 323, and the fixed end plate 321 can include discharge hole 326 defined therein through which the refrigerant is discharged. The discharge hole 326 can be defined in a center direction of the fixed wrap 323, or can be spaced apart from the fixed shaft receiving portion 3281 to avoid interference with the fixed shaft receiving portion 3281, or the discharge hole 326 can include a plurality of discharge holes.

The orbiting scroll 330 can include an orbiting end plate 331 disposed between the main frame 310 and the fixed scroll 320, and an orbiting wrap 333 disposed beneath the orbiting end plate to define the compression chamber together with the fixed wrap 323.

The orbiting scroll 330 can further include an orbiting through-hole 338 passing through the orbiting end plate 33. The rotatable shaft 230 is rotatably received in the orbiting through-hole 338.

In some examples, the rotatable shaft 230 can be configured such that a portion thereof coupled to the orbiting through-hole 338 is eccentric. Thus, when the rotatable shaft 230 is rotated, the orbiting scroll 330 orbits in a state of being engaged with the fixed wrap 323 of the fixed scroll 320 to compress the refrigerant.

Specifically, the rotatable shaft 230 can include a main shaft 231 coupled to the driver 200 and rotating, and a bearing portion 232 connected to the main shaft 231 and rotatably coupled to the compression assembly 300. The bearing portion 232 can be included as a member separate from the main shaft 231, and can accommodate the main shaft 231 therein, or can be integrated with the main shaft 231.

The bearing portion 232 can include a main bearing portion **232*a* inserted into the main shaft receiving portion 318 of the main frame 310 and radially supported thereon, a fixed bearing portion 232*a* inserted into the fixed shaft receiving portion 3281 of the fixed scroll 320 and radially supported thereon, and an eccentric shaft 232*b* disposed between the main bearing portion 232*a* and the fixed bearing portion 232*a*, and inserted into the orbiting through-hole 338 of the orbiting scroll 330**.

In this connection, the main bearing portion **232*a* and the fixed bearing portion 232*a* can be coaxial to have the same axis center, and the eccentric shaft 232*b* can be formed such that a center of gravity thereof is radially eccentric with respect to the main bearing portion 232*a* or the fixed bearing portion 232*a*. In addition, the eccentric shaft 232*b* can have an outer diameter greater than an outer diameter of the main bearing portion 232*a* or an outer diameter of the fixed bearing portion 232*a*. As such, the eccentric shaft 232*b* can provide a force to compress the refrigerant while orbiting the orbiting scroll 330 when the bearing portion 232 rotates, and the orbiting scroll 330 can be disposed to regularly orbit the fixed scroll 320 by the eccentric shaft 232*b***.

However, in order to prevent the orbiting scroll 320 from spinning, the lower scroll compressor 10 can further include an Oldham's ring 340 coupled to an upper portion of the orbiting scroll 320. The Oldham's ring 340 can be disposed between the orbiting scroll 330 and the main frame 310 to be in contact with both the orbiting scroll 330 and the main frame 310. The Oldham's ring 340 can be configured to linearly move in four directions of front, rear, left, and right directions to prevent the spinning of the orbiting scroll 320.

In some examples, the rotatable shaft 230 can be disposed to completely pass through the fixed scroll 320 to protrude out of the compression assembly 300. As a result, the rotatable shaft 230 can be in direct contact with outside of the compression assembly 300 and the oil stored in the sealing shell 130. Thus, the rotatable shaft 230 can rotate to pull up the oil which in turn can be fed into the compression assembly 300.

An oil supply channel 234 for supplying the oil to an outer circumferential face of the main bearing portion **232*a*, an outer circumferential face of the fixed bearing portion 232*a*, and an outer circumferential face of the eccentric shaft 232*b* can be defined in an outer circumferential face of or inside the rotatable shaft 230**.

In addition, a plurality of oil holes **234*a*, 234*b*, 234*c*, and 234*d* can be defined in the oil supply channel 234. Specifically, the oil hole can include a first oil hole 234*a*, a second oil hole 234*b*, a third oil hole 234*c*, and a fourth oil hole 234*d*. First, the first oil hole 234*a* can be defined to pass through the outer circumferential face of the main bearing portion 232*a***.

The first oil hole 234*a* can be defined to penetrate into the outer circumferential face of the main bearing portion 232*a* in the oil supply channel 234. In addition, the first oil hole 234*a* can be defined to penetrate, for example, an upper portion of the outer circumferential face of the main bearing portion 232*a*. However, the present disclosure is not limited thereto. That is, the first oil hole 234*a* can be defined to penetrate a lower portion of the outer circumferential face of the main bearing portion 232*a*. In some examples, the first oil hole 234*a* can include a plurality of holes. In addition, when the first oil hole 234*a* includes the plurality of holes, the plurality of holes can be defined only in the upper portion or only in the lower portion of the outer circumferential face of the main bearing portion 232*a*, or can be defined in both the upper and lower portions of the outer circumferential face of the main bearing portion 232*a*.

In addition, the rotatable shaft 230 can include an oil feeder 233 disposed to pass through a muffler 500 to be described later to be in contact with the stored oil of the casing 100. The oil feeder 233 can include an extension shaft 233*a* passing through the muffler 500 and in contact with the oil, and a spiral groove 233*b* spirally defined in an outer circumferential face of the extension shaft 233*a* and in communication with the supply channel 234.

Thus, when the rotatable shaft 230 is rotated, due to the spiral groove 233*b*, a viscosity of the oil, and a pressure difference between a high pressure region 51 and an intermediate pressure region V1 inside the compression assembly 300, the oil rises through the oil feeder 233 and the supply channel 234 and is discharged into the plurality of oil holes. The oil discharged through the plurality of oil holes 234*a*, 234*b*, 234*c*, and 234*d* not only maintains an airtight state by forming an oil film between the fixed scroll 320 and the orbiting scroll 330, but also absorbs frictional heat generated at friction portions between the components of the compression assembly 300 and discharge the heat.

The oil guided along the rotatable shaft 230 and supplied through the first oil hole 234*a* can lubricate the main frame 310 and the rotatable shaft 230. In addition, the oil can be discharged through the second oil hole 234*b* and supplied to a top face of the orbiting scroll 330, and the oil supplied to the top face of the orbiting scroll 330 can be guided to the intermediate pressure region through the pocket groove 314. In some examples, the oil discharged not only through the second oil hole 234*b* but also through the first oil hole 234*a* or the third oil hole 234*c* can be supplied to the pocket groove 314.

In some examples, the oil guided along the rotatable shaft 230 can be supplied to the Oldham's ring 340 installed between the orbiting scroll 330 and the main frame 310 and to the fixed side plate 322 of the fixed scroll 320. Thus, wear of the fixed side plate 322 of the fixed scroll 320 and the Oldham's ring 340 can be reduced. In addition, the oil supplied to the third oil hole 234*c* is supplied to the compression chamber to not only reduce wear due to friction between the orbiting scroll 330 and the fixed scroll 320, but also form the oil film and discharge the heat, thereby improving a compression efficiency.

Although a centrifugal oil supply structure in which the lower scroll compressor 10 uses the rotation of the rotatable shaft 230 to supply the oil to the bearing has been described, the centrifugal oil supply structure is merely an example. Further, a differential pressure supply structure for supplying oil using a pressure difference inside the compression assembly 300 and a forced oil supply structure for supplying oil through a trochoid pump, and the like can also be applied.

In some examples, the compressed refrigerant is discharged to the discharge hole 326 along a space defined by the fixed wrap 323 and the orbiting wrap 333. The discharge hole 326 can be more advantageously disposed toward the refrigerant discharger 121. This is because the refrigerant discharged from the discharge hole 326 is most advantageously delivered to the refrigerant discharger 121 without a large change in a flow direction.

However, because of the structural characteristics that the driver 200 should be disposed between the compression assembly 300 and the refrigerant discharger 121, and that the fixed scroll 320 should constitute an outermost portion of the compression assembly 300, the discharge hole 326 is defined to spray the refrigerant in a direction opposite to a direction toward the refrigerant discharger 121.

In other words, the discharge hole 326 is defined to spray the refrigerant in a direction away from the refrigerant discharger 121 with respect to the fixed end plate 321. Therefore, when the refrigerant is sprayed into the discharge hole 326 as it is, the refrigerant may not be smoothly discharged to the refrigerant discharger 121, and when the oil is stored in the sealing shell 130, the refrigerant can collide with the oil and be cooled or mixed.

In order to prevent this situation, the compressor 10 can further include a muffler 500 coupled to an outermost portion of the fixed scroll 320 and providing a space for guiding the refrigerant to the refrigerant discharger 121.

The muffler 500 can be disposed to seal one face disposed in a direction farther away from the refrigerant discharger 121 of the fixed scroll 320 to guide the refrigerant discharged from the fixed scroll 320 to the refrigerant discharger 121.

The muffler 500 can include a coupling body 520 coupled to the fixed scroll 320, a receiving body 510 extending from the coupling body 520 to define a sealed space therein, and a muffler shaft receiving portion 541 through which the rotatable shaft 230 passes so that the rotatable shaft 230 can contact the oil storage space S. Thus, the refrigerant sprayed from the discharge hole 326 can have the flow direction change along the sealed space defined in the muffler 500 and thus can be discharged to the refrigerant discharger 121.

Further, since the fixed scroll 320 is coupled to the receiving shell 110, the refrigerant can be restricted from flowing to the refrigerant discharger 121 by being interrupted by the fixed scroll 320. Therefore, the fixed scroll 320 can further include a bypass hole 327 defined therein allowing the refrigerant penetrated the fixed end plate 321 to pass through the fixed scroll 320. The bypass hole 327 can be disposed to be in communication with the main hole 331*a*. Thus, the refrigerant can pass through the compression assembly 300, pass the driver 200, and be discharged to the refrigerant discharger 121.

Further, as the refrigerant flows more inwardly from an outer circumferential face of the fixed wrap 323, the refrigerant is compressed to have a higher pressure. Thus, an interior of the fixed wrap 323 and an interior of the orbiting wrap 333 is maintained in a high pressure state. Accordingly, a discharge pressure is exerted to a rear face of the orbiting scroll as it is. Thus, in a reaction manner thereto, the backpressure is exerted from the orbiting scroll 330 toward the fixed scroll 320. The compressor 10 can further include a backpressure seal 350 that concentrates the backpressure on a portion where the orbiting scroll 320 and the rotatable shaft 230 are coupled to each other, thereby preventing leakage between the orbiting wrap 333 and the fixed wrap 323.

The backpressure seal 350 is disposed in a ring shape to maintain an inner circumferential face thereof at a high pressure, and separate an outer circumferential face thereof at an intermediate pressure lower than the high pressure. Therefore, the backpressure is concentrated on the inner circumferential face of the backpressure seal 350, so that the orbiting scroll 330 is in close contact with the fixed scroll 320.

In this connection, when considering that the discharge hole 326 is defined to be spaced apart from the rotatable shaft 230, the backpressure seal 350 can be configured such that a center thereof is biased toward the discharge hole 326.

In some examples, the oil supplied to the compression assembly 300, or the oil stored in the oil storage space P of the casing 100 can flow toward an upper portion of the casing 100 together with the refrigerant as the refrigerant is discharged to the refrigerant discharger 121. In this connection, because the oil is denser than the refrigerant, the oil may not be able to flow to the refrigerant discharger 121 by a centrifugal force generated by the rotor 220, and can be attached to inner walls of the discharge shell 120 and the receiving shell 110. The lower scroll compressor 10 can further include collection channels F respectively on outer circumferential faces of the driver 200 and the compression assembly 300 to collect the oil attached to an inner wall of the casing 100 to the oil storage space of the casing 100 or the sealing shell 130.

The collection channel can include a driver collection channel 201 defined in an outer circumferential face of the driver 200, a compression assembly collection channel 301 defined in an outer circumferential face of the compression assembly 300, and a muffler collection channel 501 defined in an outer circumferential face of the muffler 500.

The driver collection channel 201 can be defined by recessing a portion of an outer circumferential face of the stator 210 is recessed, and the compression assembly collection channel 301 can be defined by recessing a portion of an outer circumferential face of the fixed scroll 320. In addition, the muffler collection channel 501 can be defined by recessing a portion of the outer circumferential face of the muffler. The driver collection channel 201, the compression assembly collection channel 301, and the muffler collection channel 501 can be defined in communication with each other to allow the oil to pass therethrough.

Further, because the rotatable shaft 230 has a center of gravity biased to one side due to the eccentric shaft 232*b*, during the rotation, an unbalanced eccentric moment occurs, causing an overall balance to be distorted. Accordingly, the lower scroll compressor 10 can further include a balancer 400 that can offset the eccentric moment that can occur due to the eccentric shaft 232*b*.

In some examples, where the compression assembly 300 is fixed to the casing 100, the balancer 400 can be coupled to the rotatable shaft 230 itself or the rotor 220 disposed to rotate. Therefore, the balancer 400 can include a central balancer 420 disposed on a bottom of the rotor 220 or on a face facing the compression assembly 300 to offset or reduce an eccentric load of the eccentric shaft 232*b*, and an outer balancer 410 coupled to a top of the rotor 220 or the other face facing the refrigerant discharger 121 to offset an eccentric load or an eccentric moment of at least one of the eccentric shaft 232*b* and the central balancer 420.

In some examples, where the central balancer 420 is disposed relatively close to the eccentric shaft 232*b*, the central balancer 420 can directly offset the eccentric load of the eccentric shaft 232*b*. Accordingly, the central balancer 420 can be disposed eccentrically in a direction opposite to the direction in which the eccentric shaft 232*b* is eccentric. As a result, even when the rotatable shaft 230 rotates at a low speed or a high speed, because a spacing away from the eccentric shaft 232*b* is close, the central balancer 420 can effectively offset an eccentric force or the eccentric load generated in the eccentric shaft 232*b* almost uniformly.

The outer balancer 410 can be disposed eccentrically in a direction opposite to the direction in which the eccentric shaft 232*b* is eccentric. However, the outer balancer 410 can be eccentrically disposed in a direction corresponding to the eccentric shaft 232*b* to partially offset the eccentric load generated by the central balancer 420.

As a result, the central balancer 420 and the outer balancer 410 can offset the eccentric moment generated by the eccentric shaft 232*b* to assist the rotatable shaft 230 to rotate stably.

Further, referring to FIG. 1, a plurality of discharge holes 326 can be defined.

Generally, in the scroll compressor, the fixed wrap 323 and the orbiting wrap 333 extend radially around the center of the fixed scroll 320 as in a logarithmic spiral or involute shape. Therefore, since the center of the fixed scroll 320 has the highest pressure, it is common to define a discharge hole 326 in the center thereof.

However, in the lower scroll compressor 10, since the rotatable shaft 230 passes through the fixed end plate 321 of the fixed scroll 320, the discharge hole 326 cannot be located in the center of the wrap. Therefore, the compressor 10 can include discharge holes 326*a* and 326*b* defined in the inner circumferential face and the outer circumferential face of the center of the orbiting wrap, respectively (See FIGS. 2A to 2C).

Furthermore, during low-load operation such as partial load, over-compression of the refrigerant may occur in the space having the discharge hole 326, thereby reducing efficiency. Therefore, in some implementations, a plurality of discharge holes can be further defined in and along the inner circumferential face or the outer circumferential face of the orbiting wrap (Multi-step discharge scheme).

Hereinafter, with reference to FIGS. 2A to 2C, an operating aspect of the lower scroll compressor 10 will be described.

Figure 2A:
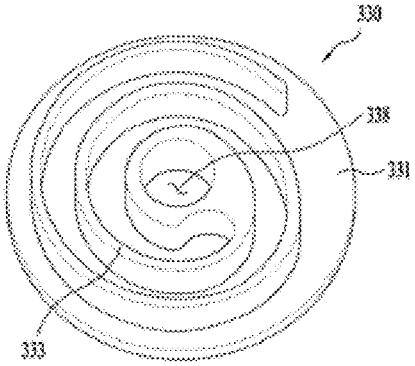
FIGS. 2A to 2C are diagrams showing an example of an operating principle of a compression assembly.
Figure 2B:
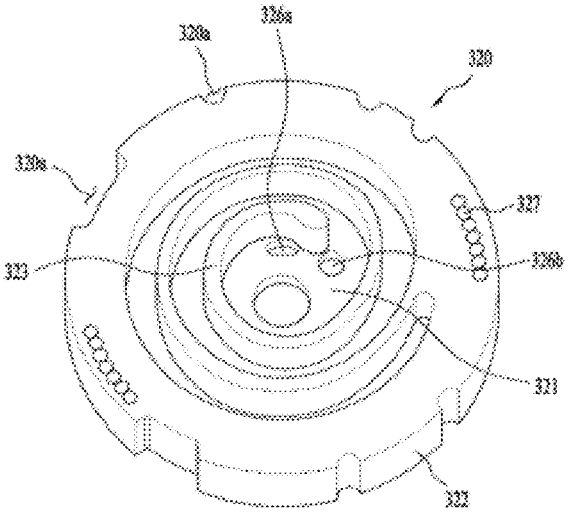
Figure 2C:
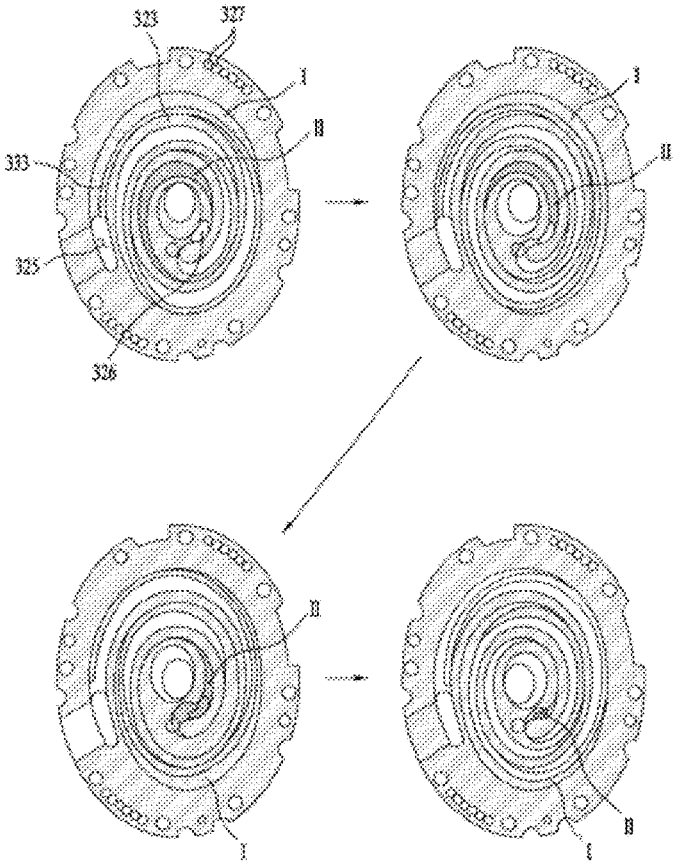

FIG. 2A illustrates the orbiting scroll, FIG. 2B illustrates the fixed scroll, and FIG. 2C illustrates a process in which the orbiting scroll and the fixed scroll type compress the refrigerant.

The orbiting scroll 330 can include the orbiting wrap 333 on one face of the orbiting end plate 331, and the fixed scroll 320 can include the fixed wrap 323 on one face of the fixed end plate 321 facing toward the orbiting scroll 330.

In some implementations, the orbiting scroll 330 can be implemented as a sealed rigid body to prevent the refrigerant from being discharged to the outside. However, the fixed scroll 320 can include the inflow hole 325 in communication with a refrigerant supply pipe such that the refrigerant at a low temperature and a low pressure can inflow, and the discharge hole 326 through which the refrigerant of a high temperature and a high pressure is discharged. Further, a bypass hole 327 through which the refrigerant discharged from the discharge hole 326 is discharged can be defined in an outer circumferential face of the fixed scroll 320.

The fixed wrap 323 and the orbiting wrap 333 can be configured to extend radially from an outer face of the fixed shaft receiving portion 3281. Therefore, a radius of each of the fixed wrap 323 and the orbiting wrap 333 can be relatively larger than that in the conventional scroll compressor. As a result, when the fixed wrap 323 and the orbiting wrap 333 have a logarithmic spiral or involute shape, a curvature decreases and thus a compression ratio decreases. Further, a strength of each of the fixed wrap 323 and the orbiting wrap 333 is weakened such that there is a risk of deformation.

Accordingly, in the compressor 10, the fixed wrap 323 and the orbiting wrap 333 can have a shape of a combination of a plurality of arcs whose curvatures continuously vary. For example, each of the fixed wrap 323 and the orbiting wrap 333 can be implemented as a hybrid wrap having a shape of a combination of at least 20 arcs whose curvatures continuously vary.

Further, in the lower scroll compressor 10, the rotatable shaft 230 is configured to penetrate the fixed scroll 320 and the orbiting scroll 330, such that a radius of curvature and a compression space of each of the fixed wrap 323 and orbiting wrap 333 are reduced.

Therefore, in order to compensate for this reduction, the compressor 10, the radius of curvature of each of the fixed wrap 323 and the orbiting wrap 333 at a portion thereof immediately before a discharge point can be smaller than that of the shaft receiving portion of the rotatable shaft such that the space to which the refrigerant is discharged can be reduced and a compression ratio can be improved. That is, each of the fixed wrap 323 and the orbiting wrap 333 can be configured to have the radius of curvature varying based on a position such that the radius of curvature thereof at the vicinity of the discharge hole 326 is the smallest and then the radius of curvature thereof gradually increases toward the inflow hole 325.

Referring to FIG. 2C, refrigerant I is flowed into the inflow hole 325 of the fixed scroll 320, and refrigerant II flowed before the refrigerant I flows is located near the discharge hole 326 of the fixed scroll 320.

In this connection, the refrigerant I is present in a region on outer circumferential faces of the fixed wrap 323 and the orbiting wrap 333 where the fixed wrap 323 and the orbiting wrap 333 are engaged with each other, and the refrigerant II is present in a sealed manner in another region in which the fixed wrap 323 and the orbiting wrap 333 are engaged with each other at two contact points.

Thereafter, when the orbiting scroll 330 starts to orbit, as the region in which the fixed wrap 323 and the orbiting wrap 333 are engaged with each other at two contact points is displaced along an extension direction of the orbiting wrap 333 and the orbiting wrap 333, such that a volume of the region begins to be reduced. Thus, the refrigerant I starts to flow and be compressed. The refrigerant II starts to be further reduced in volume, be compressed, and guided to the discharge hole 326.

The refrigerant II is discharged from the discharge hole 326. As the region in which the fixed wrap 323 and the orbiting wrap 333 are engaged with each other at two contact points is displaced in a clockwise direction, the refrigerant I flows, and the volume of the refrigerant I starts to decrease such that refrigerant I is further compressed.

As the region in which the fixed wrap 323 and the orbiting wrap 333 are engaged with each other at two contact points is displaced again in the clockwise direction and thus is closer to an interior of the fixed scroll, the volume of the refrigerant I further decreases and the discharge of the refrigerant II is substantially completed.

As such, as the orbiting scroll 330 orbits, the refrigerant can be compressed linearly or continuously while flowing into the fixed scroll.

Although the drawing shows that the refrigerant flows into the inflow hole 325 discontinuously, this is intended only for illustrative purpose. Alternatively, the refrigerant can be supplied thereto continuously. Further, the refrigerant can be accommodated and compressed in each of regions where the fixed wrap 323 and the orbiting wrap 333 are engaged with each other at two contact points.

As described above, it is desirable that when the lower scroll compressor starts for the first time, or is left at a low temperature, and then starts, the temperature of the oil flowing in the lower scroll compressor rises. This is because when the lower scroll compressor starts for the first time, or is left at a low temperature, and then starts, a component (e.g., a bearing) to be subjected to lubrication may not be sufficiently lubricated or the oil amount can be insufficient (low oil level).

Hereinafter, referring to FIGS. 3A to 3C, the refrigerant and oil flowing inside the compressor when the compressor initially operates will be described.

Figures 3A, 3B, 3C:
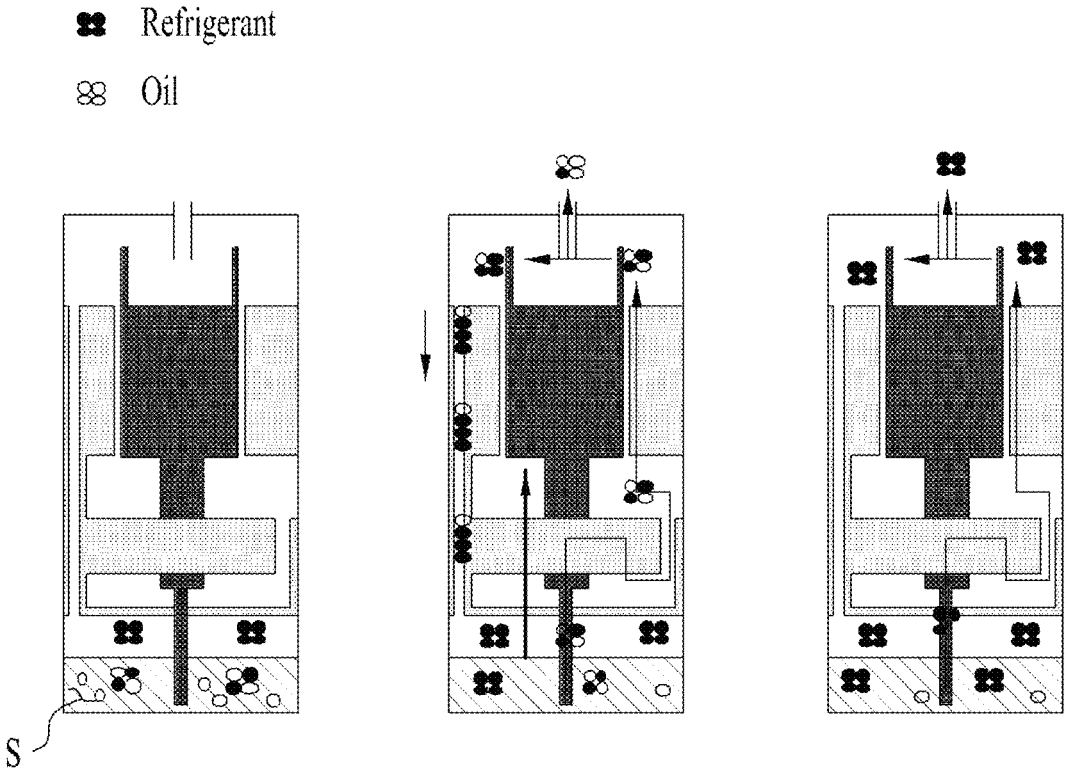
FIGS. 3A to 3C are diagrams showing examples of flow of refrigerant and oil when a compressor initially operates.

FIG. 3A is a diagram showing the refrigerant and the oil inside the compressor before the compressor is left at a low temperature or the compressor starts. FIG. 3B is a diagram showing the refrigerant and the oil inside the compressor immediately after the compressor starts. FIG. 3C is a diagram showing the refrigerant and the oil inside the compressor when the oil is not sufficiently heated after the compressor starts.

Referring to FIG. 3A, before the compressor starts, or when the compressor has been left at low temperature and then the compressor starts, the refrigerant in a droplet state remains inside the compressor. This is because even when the operation of the compressor is terminated, an entirety of the refrigerant received inside the compressor may not be discharged to an outside of the compressor, and the refrigerant which gradually loses thermal energy can be converted into a liquid phase.

Referring to FIG. 3B, the oil is not heated sufficiently immediately after the compressor starts, while the droplet state refrigerant inside the compressor can be aggregated and accumulated in the compression assembly 300 or the driver 200. In this case, even though the temperature of the oil is low, the oil may not have sufficient viscosity due to the refrigerant in the droplet state. Therefore, as described above, among the components of the compressor, components requiring the lubrication, for example, bearings may not be sufficiently lubricated with the oil.

In addition, referring to FIG. 3C, when a predefined time duration has lapsed after the compressor starts, the droplet state refrigerant evaporates but the oil is not heated sufficiently. In this case, an amount of the oil flowing inside the compressor except for the oil storage space S can be drastically reduced. This is because a sufficient amount of the oil may not flow inside the compressor as the droplet state refrigerant evaporates.

Therefore, when the compressor starts, it is necessary to increase the temperature of the oil more rapidly. This is because when the oil temperature rises, the viscosity of the oil will decrease, and thus when the viscosity of the oil is low, the oil can flow quickly to the components that require the lubrication thereof inside the compressor.

Various implementations of the present disclosure can use thermal energy of the refrigerant flowing inside the muffler 500. This is because, as described above, the refrigerant flowing in the muffler 500 has a high pressure and a high temperature.

Hereinafter, the refrigerant flowing inside the muffler 500 will be described in more detail with reference to FIG. 4.

Figure 4:
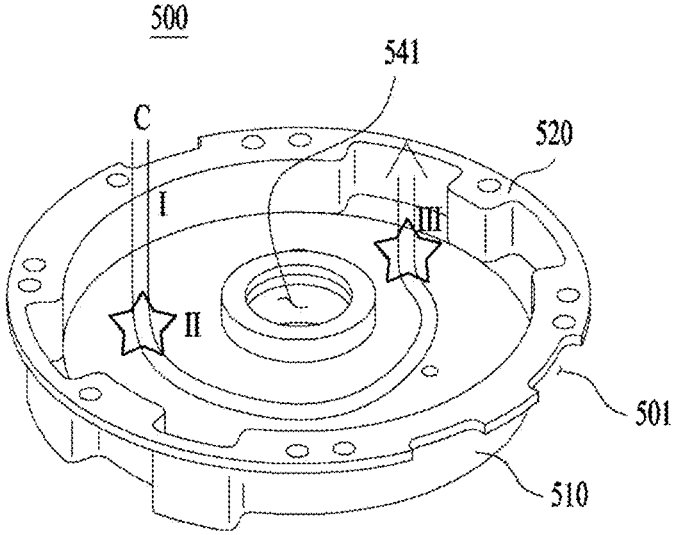
FIG. 4 is a diagram showing an example of flow of refrigerant in a muffler.

FIG. 4 is a diagram showing a refrigerant flowing in the muffler 500.

Referring to FIG. 4, the refrigerant discharged from the compression assembly 300 can flow (I) toward the inside of the muffler 500. After the refrigerant collides (II) with a bottom face of the muffler 500, the refrigerant flow direction can be changed. Further, the refrigerant flowing along and on the bottom face of the muffler 500 or the refrigerant whose the flow direction is changed inside the muffler 500 can flow (III) toward the refrigerant discharger 121. That is, the high-temperature and high-pressure refrigerant discharged from the compression assembly 300 flows in the muffler 500, and thus, the bottom face of the muffler 500 naturally exchanges the thermal energy with the high temperature and high pressure refrigerant.

Therefore, a heat radiating member 600 can allow heat exchange between the heated bottom face of the muffler 500 and the oil in the oil storage space S.

Figure 5B:
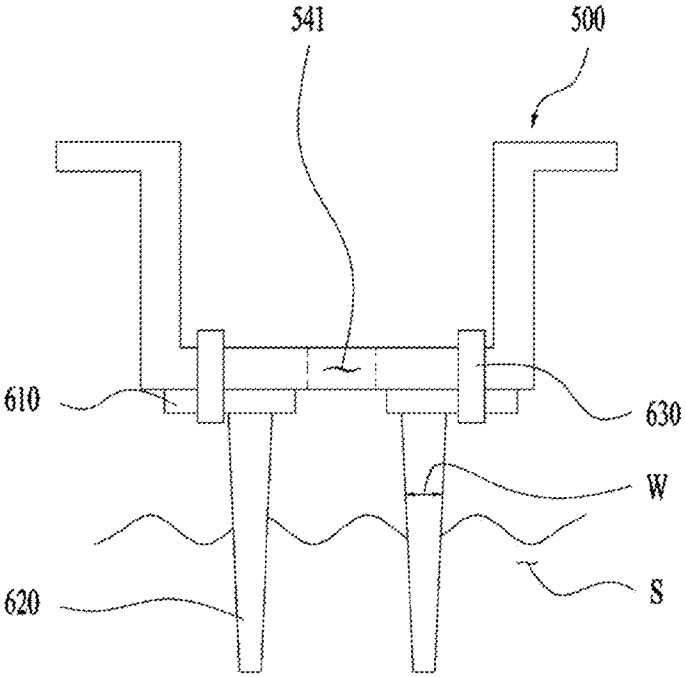
FIGS. 5A and 5B are diagrams showing an example of a heat radiating member.
Figure 5A:
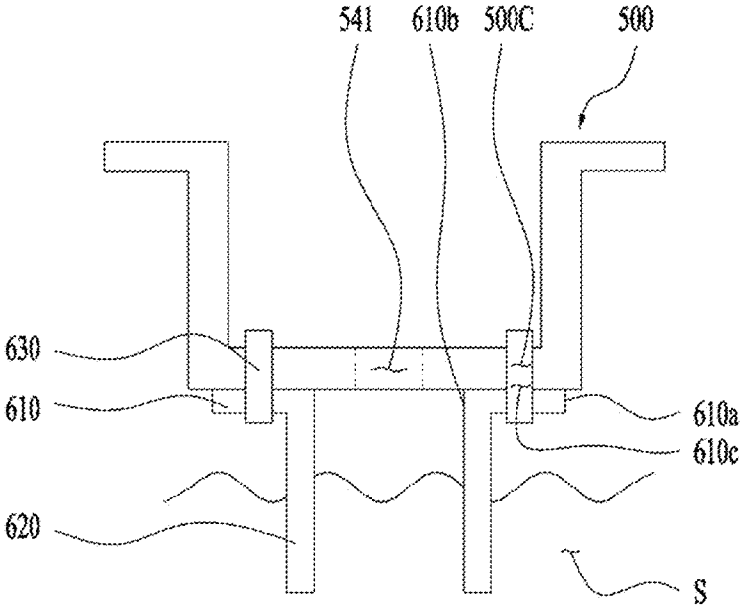

Hereinafter, the heat radiating member 600 will be described in detail with reference to FIGS. 5A and 5B. FIGS. 5A and 5B are diagrams showing the heat radiating member 600.

Referring to FIGS. 5A and 5B, the heat radiating member 600 can include a contact portion or contact-area increasing portion 610 coupled to the muffler 500, and a heat radiating portion 620 extending from the contact-area increasing portion 610 toward the oil storage space S and contacting the oil.

For example, the contact-area increasing portion 610 can be coupled to the bottom face of the muffler 500 and exchange heat with the muffler 500. More specifically, the bottom face of the muffler 500 includes one face facing toward the oil storage space S. The contact-area increasing portion 610 can be in contact with the one face and exchange heat with the muffler 500. Therefore, the contact-area increasing portion 610 can have a plane parallel to the one face and can exchange heat with the one face in a reliable manner.

The heat radiating portion 620 can extend from a partial region of the contact-area increasing portion 610 toward the oil storage space S and contact the oil. That is, the contact-area increasing portion 610 can contact the muffler 500 over a larger area to secure a larger contact area with the muffler 500, whereas the heat radiating portion 620 can extend from the partial region of the contact-area increasing portion 610 and can exchange the heat with the oil in a concentrated manner.

The contact-area increasing portion 610 and the heat radiating portion 620 can be integrally formed with each other, or can be manufactured in a separate manner and then combined with each other via welding or the like. Further, the contact-area increasing portion 610 and the heat radiating portion 620 can be integrally formed with the muffler 500.

When the contact-area increasing portion 610 and the heat radiating portion 620 are not formed integrally with the muffler 500, the heat radiating member 600 can include a fastener 630 for fastening the contact-area increasing portion 610 or the heat radiating portion 620 to the muffler 500.

The fastener 630 can fasten the bottom face of the muffler 500 to the contact-area increasing portion 610. To this end, the fastener 630 can fasten the bottom face of the muffler 500 to the contact-area increasing portion 610 in a bolting or riveting manner. Thus, the fastener 630 can include a bolt or a rivet. In this connection, the muffler 500 and the contact-area increasing portion 610 can have through-holes 500*c* and 610*c* respectively through which the fastener 630 passes.

The fastener 630 can fasten the muffler 500 and the contact-area increasing portion 610 to each other at a position that the fastening does not interfere with the heat radiating portion 620. Further, the heat radiating portion 620 can extend from the contact-area increasing portion 610 at a position thereof closer to the rotatable shaft 230 than to the fastener 630. This is because when the oil is fed along the rotatable shaft 230, the oil flowing along the rotatable shaft 230 is more likely to be located inside or closer to the center of the oil storage space S.

In other words, the heat radiating portion 620 can extend from the contact-area increasing portion 610 at a position thereof closer to the muffler shaft receiving portion 541 toward the oil storage space S. That is, a spacing between the heat radiating portion 620 and the muffler shaft receiving portion 541 along the radial direction of the rotatable shaft 230 can be smaller than a spacing between the fastener 630 and the muffler shaft receiving portion 541 along the radial direction of the rotatable shaft 230.

Further, the heat radiating portion 620 can extend from an inner end of the contact-area increasing portion 610 and can exchange the heat with the oil at a position closest to the rotatable shaft 230.

FIG. 5A is a diagram showing a state that the heat radiating portion 620 extends from the inner end of the contact-area increasing portion 610.

Referring to FIG. 5A, the contact-area increasing portion 610 can include both opposing ends 610*a* and 610*b* spaced from each other in a radial direction of the rotatable shaft 230.

A first end 610*b* refers to a portion of the contact-area increasing portion 610 that is closest, in the radial direction of the rotatable shaft 230, to the rotatable shaft 230. A second end 610*a* refers to a portion of the contact-area increasing portion 610 that is farthest from the rotatable shaft 230 in the radial direction of the rotatable shaft 230.

In other words, the first end 610*b* can refer to a portion located closest, in the radial direction of the rotatable shaft 230, to the muffler shaft receiving portion 541. The second end 610*a* can refer to a portion spaced farthest from the muffler shaft receiving portion 541 along the radial direction of the rotatable shaft 230.

In this connection, the heat radiating portion 620 can extend from the first end 610*b* toward the oil storage space S and can contact the oil.

In addition, when the heat radiating portion 620 extends from the first end 610*b* toward the oil storage space S, the contact-area increasing portion 610 can be integrally formed with the heat radiating portion 620, and the heat radiating portion 620 can be bent from the contact-area increasing portion 610.

Thus, the heat radiating portion 620 can be located more inwardly than the fastener 630 and can exchange heat with the oil located closer to the rotatable shaft 230 as located in the oil storage space S.

Further, the heat radiating portion 620 can extend from the contact-area increasing portion 610 along a length direction of the rotatable shaft 230. Alternatively, the heat radiating portion 620 can extend from the contact-area increasing portion 610 in parallel with the longitudinal direction of the rotatable shaft 230. In some examples, a width of the heat radiating portion 620 can vary as the heat radiating portion 620 downwardly extends from the contact-area increasing portion 610.

FIG. 5B is a diagram showing a state in which a width of the heat radiating portion 620 varies in an extension direction thereof.

Referring to FIG. 5B, as the heat radiating portion 620 extends from the contact-area increasing portion 610 along the longitudinal direction of the rotatable shaft 230, a width w thereof in the radial direction of the rotatable shaft 230 can vary. That is, the width w thereof can gradually vary as the heat radiating portion 620 extends downwardly. In some examples, as shown in FIG. 5B, the width w of the heat radiating portion 620 can gradually decrease along the extending direction of the heat radiating portion 620. That is, the heat radiating portion 620 can extend in a tapered manner along the extending direction thereof.

When the width w of the heat radiating portion 620 gradually decreases along the extending direction of the heat radiating portion 620, a cross-sectional area of the heat radiating portion 620 can gradually decrease along the extending direction of the heat radiating portion 620. Therefore, the heat radiating portion 620 can exchange a large amount of the heat with the oil at a top thereof adjacent to the contact-area increasing portion 610 than at a bottom thereof. Thus, the larger amount of the thermal energy exchanged at the adjacent top can be rapidly transferred downwardly and along the extending direction of the heat radiating portion 620 to the bottom via the tapered portion whose the cross-sectional area gradually decreases.

Thus, when the heat radiating portion 620 is tapered from the top to the bottom along the extension direction thereof, the thermal energy exchanged at the contact-area increasing portion 610 can be transferred to the oil more rapidly.

In this connection, FIG. 5B shows a state in which the width w of the heat radiating portion 620 continuously and constantly decreases along the extension direction of the heat radiating portion 620 to have a constantly sloped liner side face. However, the present disclosure is not limited thereto. For example, the width w of the heat radiating portion 620 can decrease along the extending direction of the heat radiating portion 620 such that the heat radiating portion 620 has a curvedly extending side face.

In some examples, the heat radiating portion 620 can have a wide cross-sectional area. The wide cross-sectional area of the heat radiating portion 620 can provide an increase of a contact area with the oil. When the area thereof in contact with the oil increases, an amount of the thermal energy to be exchanged with the oil can increase.

In some implementations, the heat radiating portion 620 can include a plurality of heat radiating portions 620.

Figure 6A:
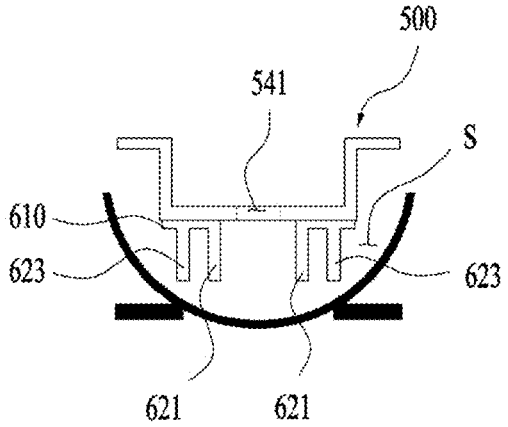
FIGS. 6A and 6B are diagrams showing examples of the heat radiating member including a plurality of heat radiating portions.
Figure 6B:
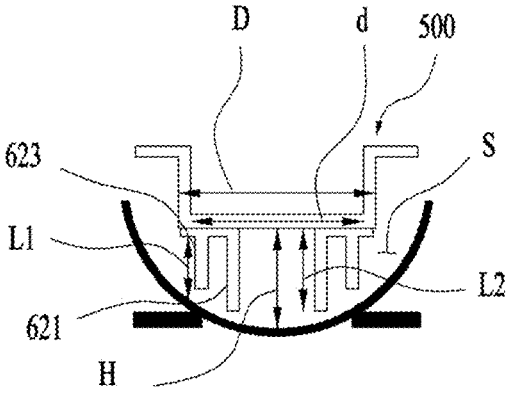

FIG. 6A and FIG. 6B are diagrams showing examples arrangements of a plurality of heat radiating portions 620.

Referring to FIG. 6A, the heat radiating portion 620 can include a first heat radiating portion 621 and a second heat radiating portion 623 which are spaced apart from each other.

The first heat radiating portion 621 and the second heat radiating portion 623 can be spaced from each other in the radial direction of the rotatable shaft 230 and can contact the oil. That is, a location of the oil which the first heat radiating portion 621 contacts in the oil storage space S and a location of the oil which the second heat radiating portion 623 contacts in the oil storage space S can be different from each other.

More specifically, the heat radiating portion 620 can include the first heat radiating portion 621 constructed to surround at least a portion of the rotatable shaft 230 and spaced apart from the rotatable shaft 230, and can further include the second heat radiating portion 623 constructed to surround at least a portion of the rotatable shaft 230 and spaced apart from the rotatable shaft 230 by a larger spacing than that by which the first heat radiating portion 621 is spaced from the rotatable shaft 230.

In other words, the first heat radiating portion 621 can be spaced apart from the muffler shaft receiving portion 541 and can be configured to surround at least a portion of the muffler shaft receiving portion 541. The second heat radiating portion 623 can be spaced apart from the first heat radiating portion 621 by a larger spacing than that by which the first heat radiating portion 621 is spaced from the muffler shaft receiving portion 541 and can be configured to surround at least a portion of the muffler shaft receiving portion 541. The second heat radiating portion 623 can also surround at least a portion of the first heat radiating portion 621.

Therefore, the first heat radiating portion 621 can exchange the heat with the oil disposed closer to the rotatable shaft 230, while the second heat radiating portion 623 can exchange the heat with the oil that is located far away from the rotatable shaft 203.

In addition, as the heat radiating portion 620 includes the first heat radiating portion 621 and the second heat radiating portion 623, an area thereof in contact with the oil located in the oil storage space S can increase, thereby allowing exchange of a larger amount of the heat with the oil.

In some examples, the oil storage space S in which the oil is stored can be defined in an oil storage casing S10. The oil storage casing S10 has no special restriction on a shape thereof as long as the casing has a space defined therein for storing the oil therein. In some examples, the oil storage casing S10 can have a hollow hemisphere structure including a curved face such that the oil can be stored in a concentrated manner on a location at which the structure contacts the rotatable shaft 230 (see FIG. 6A).

In particular, when the oil storage casing S10 has a hollow hemisphere structure, a vertical position of the oil stored in the oil storage casing S10 can vary depending on a location of the oil storage casing S10. In other words, the oil in the oil storage casing S10 is located at a deeper level as a location is closer to a position corresponding to that of the rotatable shaft, that is, to a center of the oil storage casing S10, while the oil in the oil storage casing S10 is located at a shallower level as a location is far away from a position corresponding to that of the rotatable shaft, that is, from a center of the oil storage casing S10. In this case, a vertical length of the second heat radiating portion 623 from the contact-area increasing portion 610 can be smaller than that of the first heat radiating portion 621.

Therefore, in order to increase the area of the heat radiating portion 620 in contact with the oil, the vertical extensions of the first heat radiating portion 621 and the second heat radiating portion 623 from the contact-area increasing portion 610 can be different from each other.

FIG. 6B is a diagram showing a state in which the first heat radiating portion 621 and the second heat radiating portion 623 have different lengths.

Referring to FIG. 6B, the first heat radiating portion 621 and the second heat radiating portion 623 can extend vertically from the contact-area increasing portion 610 toward the oil storage space S by lengths L2 and L1, respectively.

In particular, as described above, the oil in the oil storage casing S10 is located at a deeper level as a location is closer to a position corresponding to that of the rotatable shaft, that is, to a center of the oil storage casing S10, while the oil in the oil storage casing S10 is located at a shallower level as a location is far away from a position corresponding to that of the rotatable shaft, that is, from a center of the oil storage casing S10. Thus, in this case, a length L2 of the first heat radiating portion 621 can be larger than a length L1 of the second heat radiating portion 623 (L2>L1).

As a result, the first heat radiating portion 621 can exchange a larger amount of thermal energy with the oil while exchanging the heat with the oil at a location close to the rotatable shaft 230.

In some examples, the length L of the heat radiating portion 620 can be less than a spacing H from the bottom face of the muffler 500 to the lowest point of the oil storage casing S10. However, when the length L of the heat radiating portion 620 is too small, the contact area thereof with the oil for heat exchange can be reduced. Thus, the length L of the heat radiating portion 620 can be greater than a half of the spacing H from the bottom face of the muffler 500 to the lowest point of the oil storage casing S10.

In some examples, a diameter d of the second heat radiating portion 623 having an annular shape when viewed from above can be less than a diameter D of the muffler 500 having an annular shape when viewed from above. In some cases, where the second heat radiating portion 623 is positioned beyond an edge of the bottom face of the muffler 500, the second heat radiating portion 623 can interfere with the oil storage casing S10 and thus may not have a sufficient area thereof in contact with the oil. In some cases, where the second heat radiating portion 623 is too close to the rotatable shaft 230, a sufficient area of the heat radiating portion in contact with the oil may not be secured. Thus, the diameter d of the second heat radiating portion 623 can be larger than a half of the diameter D of the muffler 500.

In another example, when the oil storage casing S10 is formed differently from that shown in FIGS. 6A and 6B and thus a location of the lowest point thereof can be changed or a shape thereof itself can be changed. In this case, the length L2 of the first heat radiating portion 621 can be smaller than the length L1 of the second heat radiating portion 623 (L2<L1).

The collection channel F can be in communication with the oil storage space S, and the gaseous refrigerant can flow inside the lower scroll compressor. Thus, the oil as well as the refrigerant can flow in the oil storage space S. In particular, the oil storage space S has a relatively low temperature compared to that of the compression assembly 300. Thus, the refrigerant flowing in the oil storage space S can be converted into a droplet state. Further, even when the refrigerant flows in the oil storage space S in a gas phase, the refrigerant may not be smoothly discharged to the outside of the oil storage space S due to the presence of the heat radiating member 600.

When the refrigerant is constantly trapped in the oil storage space S, this can affect the viscosity of the oil. In particular, this can reduce the heat exchange efficiency of the heat radiating member 600. In some examples, the heat radiating member 600 can include a communication opening 625 for communicating the refrigerant flowing into the oil storage space S with the outside.

Figure 7B:
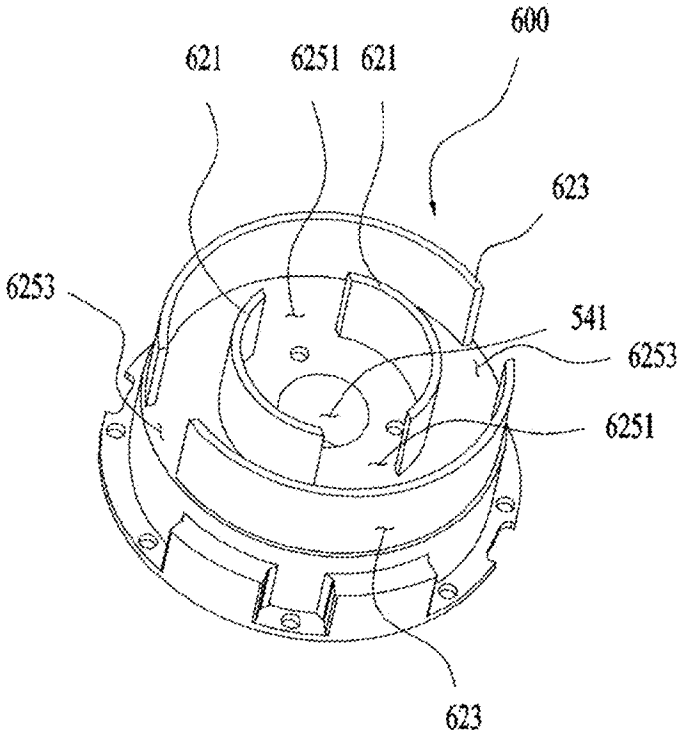
FIGS. 7A and 7B are diagrams showing examples of a communication opening.
Figure 7A:
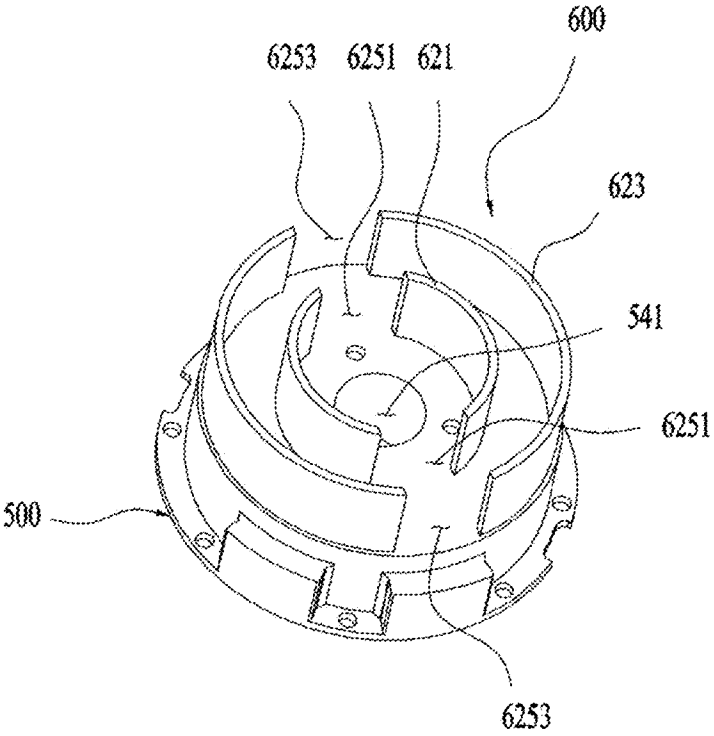

FIGS. 7A and 7B are diagrams showing a shape of each of the communication opening 625 and the heat radiating portion 620.

Referring to FIGS. 7A and 7B, the shape of the heat radiating portion 620 has no particular limitation thereto as long as the heat radiating portion 620 only needs to include an area thereof in contact with the oil. In some examples, as described above, in order to sufficiently secure an area in which the heat radiating portion 620 contacts the oil, the heat radiating portion 620 can include a curved face. In this connection, the heat radiating portion 620 having the curved face can be implemented as a curved plate having a width in the radial direction of the rotatable shaft 230, and a height along the longitudinal direction of the rotatable shaft 230. In some implementations, the curved face can have a curvature of at least one of a circle, a partial circle, an ellipse, or a partial ellipse, as shown in FIGS. 7A and 7B.

The communication opening 625 can be configured to communicate the inside of the heat radiating portion 620 with an outside thereof. In this connection, the inside of the heat radiating portion 620 can be a space surrounded with the heat radiating portion 620 and containing the rotatable shaft 230 therein. The outside of the heat radiating portion 620 can be a space that is not surrounded with the heat radiating portion 620 and that is disposed out of the inside thereof.

The communication opening 625 can extend through at least a portion of the heat radiating portion 620. Further, when the heat radiating portion 620 includes a plurality of the heat radiating portions 620, the plurality of the heat radiating portions 620 can be spaced apart from each other to define the communication opening 625 as a spacing thereof. In this connection, the plurality of the heat radiating portion 620 do not refer to the first heat radiating portion 621 and the second heat radiating portion 623 as above-described. Rather, each of the first heat radiating portion 621 and the second heat radiating portion 623 has the plurality of the heat radiating portions spaced apart from each other to define the communication opening 625 as a spacing thereof. That is, the first heat radiating portion 621 has a plurality of first heat radiating sub-portions spaced apart from each other to define a first communication opening 625 as a spacing thereof. The second heat radiating portion 623 has a plurality of second heat radiating sub-portions spaced apart from each other to define a second communication opening 625 as a spacing thereof.

In some implementations, where the heat radiating portion 620 includes the plurality of the heat radiating portions 621 and 623 having the different spacing thereof from the rotatable shaft 230, the communication opening 625 can be defined in each of the heat radiating portions 621 and 623. In some examples, the communication opening 625 can be formed in each of the heat radiating portions 621 and 623 so that the refrigerant flowing into the oil storage space S can flow smoothly to the outside of the oil storage space S.

Accordingly, the first heat radiating portion 621 can have a first communication opening 6251 defined therein to communicate the inside of the first heat radiating portion 621 with the outside thereof. The second heat radiating portion 623 can include a second communication opening 6253 defined therein to communicate the inside of the second heat radiating portion 623 with the outside thereof.

Accordingly, the first communication opening 6251 can communicate the refrigerant located inside the first heat radiating portion 621 and closer to the rotatable shaft 230 to the outside of the first heat radiating portion 621. The second communication opening 6253 can communicate with the refrigerant located in the inside of the second heat radiating portion 623 and in the outside of the first heat radiating portion 621 and away from the rotatable shaft 230 with the outside of the second heat radiating portion 623.

That is, the first communication opening 6251 and the second communication opening 6253 can define a flow path of the refrigerant flowing into the oil storage space S.

Each of the first communication opening 6251 and the second communication opening 6253 can include a plurality of communication openings to lower flow resistance of the refrigerant. Further, the first communication opening 6251 includes first communication openings 6251 which can be opposite to each other, or can be arranged to be symmetrical with each other around the rotatable shaft 230 or the muffler shaft receiving portion 541. The second communication opening 6253 includes a plurality of second communication openings 6253 which can be opposite to each other, or can be arranged to be symmetrical with each other around the rotatable shaft 230 or the muffler shaft receiving portion 541.

Referring to FIG. 7A, the first communication openings 6251 and the second communication openings 6253 can be arranged in a linear manner. In this case, the first heat radiating portions 621 can be arranged to be symmetrical with each other around the rotatable shaft 230 or the muffler shaft receiving portion 541. The second heat radiating portions 623 can be arranged to be symmetrical with each other around the rotatable shaft 230 or the muffler shaft receiving portion 541.

In other words, the first communication openings 6251 and the second communication openings 6253 can communicate with each other in the linear manner. In this case, the refrigerant introduced into the oil storage space S can be discharged to the outside of the oil storage space S through the first communication openings 6251 and the second communication opening 6253*s* more smoothly.

However, in order to discharge the refrigerant located between the first heat radiating portion 621 and the second heat radiating portion 623 to the outside of the oil storage space S more smoothly, positions of the first communication opening 6251 and the second communication opening 6253 can be different from those in FIG. 7A.

Referring to FIG. 7B, the first communication openings 6251 and the second communication openings 6253 may not be arranged in the linear manner. That is, the first communication opening 6251 can face the second heat radiating portion 623, while the second communication opening 6253 can face the first heat radiating portion 621. In this case, the first communication openings 6251 and the second communication openings 6253 can be spaced from each other by a predefined angular spacing around the shaft 230.

Accordingly, the refrigerant located between the first heat radiating portion 621 and the second heat radiating portion 623 can be more smoothly discharged to the outside of the oil storage space S.

In some examples, the first heat radiating portion 621 can include a pair of first heat radiating portions that are spaced apart from each other in a circumferential direction and arranged outside the muffler shaft receiving portion 541 in a radial direction. The second heat radiating portion 623 can include a pair of second heat radiating portions that are spaced apart from each other in the circumferential direction and arranged outside the pair of first heat radiating portions in the radial direction. The space between the pair of first heat radiating portions can be first communication opening 6251, and the space between the pair of second heat radiating portions can be first communication opening 6253.

FIGS. 7A and 7B show a state in which each of the first heat radiating portion 621 and the second heat radiating portion 623 includes the plurality (e.g., two) of the heat radiating portions spaced from each other to defined each of the first communication opening 6251 and the second communication opening 6253 as a spacing therebetween. However, the present disclosure is not necessarily limited thereto. For example, the first heat radiating portion 621 and the second heat radiating portion 623 can have different spacings thereof from the rotatable shaft 230, but can be configured to surround the rotatable shaft 230. In this connection, the first heat radiating portion 621 can have a plurality of through-holes defined therein to act as the first communication opening 6251. The plurality of through-holes can be defined in the second heat radiating portion 623 to act as the second communication opening 6253. As such, the communication openings 625 can be defined to allow the refrigerant introduced into the oil storage space S to be not trapped by the heat radiating member 600 but to be discharged to the outside of the oil storage space S.

The contact-area increasing portion 610 is in contact with one face facing the oil storage space S of a bottom of the muffler 500. Thus, as a larger contact area thereof with the space S is secured, the heat exchange efficiency is more improved. In some examples, where the heat radiating portion 620 includes the plurality of the heat radiating portions 621 and 623 having the different spacing thereof from the rotatable shaft 230 or the muffler shaft receiving portion 541, the contact-area increasing portion 610 can be implemented as a single body to connect the plurality of the heat radiating portions 621 and 623 to one face of the muffler 500.

Figure 8:
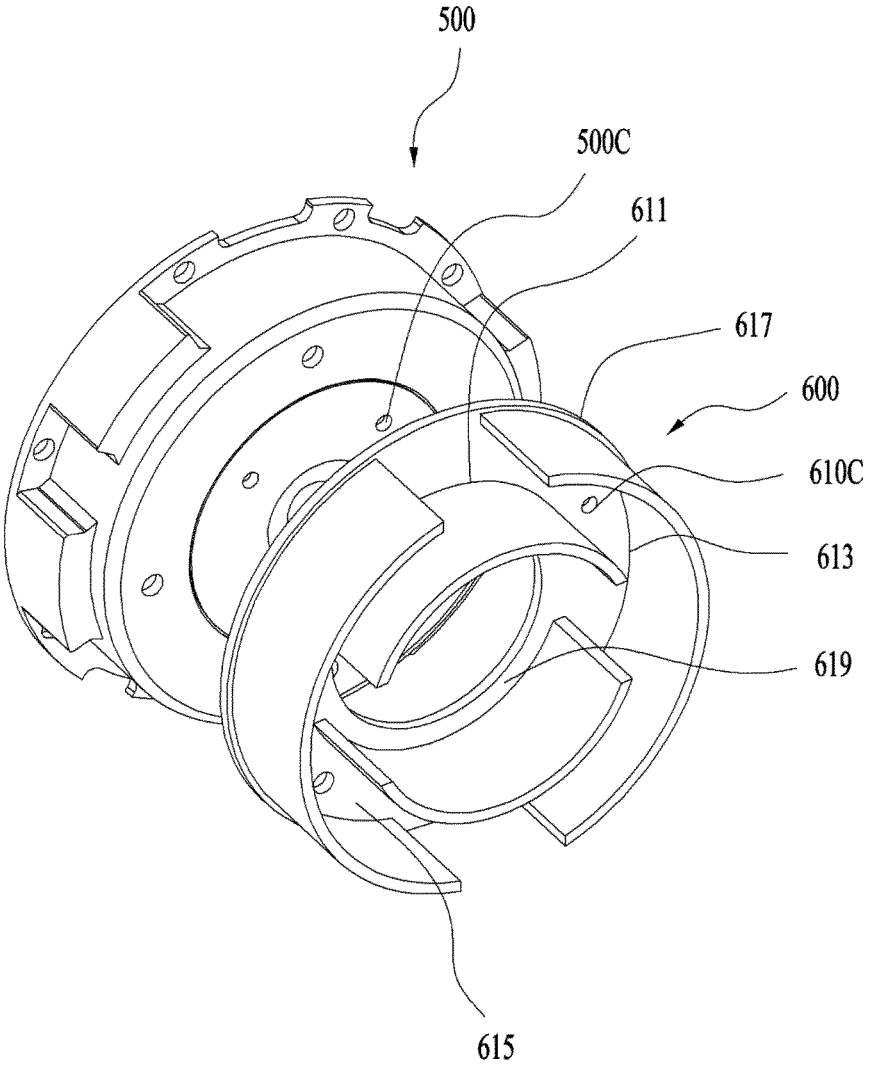
FIG. 8 is a diagram showing an example of a contact-area increasing portion that is coupled to an example of a muffler.

FIG. 8 is a diagram showing a state in which the contact-area increasing portion 610 and the heat radiating member 600 are coupled to the muffler 500.

Referring to FIG. 8, the contact-area increasing portion 610 can include a first contact portion or contact-area increasing portion 611 in contact with the first heat radiating portion 621, a second contact portion or contact-area increasing portion 613 in contact with the second heat radiating portion 623, and a third contact portion or contact-area increasing portion 615 connecting the first contact-area increasing portion 611 and the second contact-area increasing portion 613 to each other. For example, the first contact portion 611 can define a first circumference of the first heat radiating portion 621, the second contact portion 613 can define a second circumference of the second heat radiating portion 623, and the third contact portion 615 can include a flat surface or plate that is disposed between the first circumference and the second circumference.

The first contact-area increasing portion 611, the second contact-area increasing portion 613 and the third contact-area increasing portion 615 can be integrally formed with each other. In this case, the contact-area increasing portion 610 can secure an area in contact with the one face of the bottom of the muffler 500.

In addition, in order to increase the area of the contact-area increasing portion 610 in contact with the one face of the muffler 500, the contact-area increasing portion 610 can further include a fourth contact portion or contact-area increasing portion 617 that extends from the second contact-area increasing portion 613 in a direction away from the rotatable shaft 230 or the muffler shaft receiving portion 541, and a fifth contact-area increasing portion 619 extending from the first contact-area increasing portion 611 in a direction closer to the muffler shaft receiving portion 541 or to the rotatable shaft 230.

In this connection, the fifth contact-area increasing portion 619 can be spaced apart from the muffler shaft receiving portion 541 to avoid interference thereof with the muffler shaft receiving portion 541.

Further, the first contact-area increasing portion to the fifth contact-area increasing portion 611, 613, 615, 617, and 619 can be formed integrally with each other. A diameter of the fifth contact-area increasing portion 619 can correspond to a diameter of the one face of the muffler 500. For example, the diameter of the one face can be a diameter of an outermost circumference of the one face.

Further, the first contact-area increasing portion to the fifth contact-area increasing portion 611, 613, 615, 617, and 619 formed integrally with each other can be configured to be in close contact with the one face of the muffler 500.

Accordingly, the contact-area increasing portion 610 can sufficiently exchange the heat with the muffler 500 via the secured sufficient area thereof in contact with the muffler 500. Thus, the contact-area increasing portion 610 can transfer the energy receiving the muffler 500 to the heat radiating portion 620.

When the lower scroll compressor starts after being left at a low temperature or starts for the first time, the temperature of the oil is lower than the temperature of the refrigerant flowing inside the muffler 500. Thus, the refrigerant flowing inside the muffler 500 can transfer the thermal energy to the muffler 500. Then, the muffler 500 can the transfer thermal energy to the heat radiating member 600.

Specifically, the contact-area increasing portion 610 can receive the thermal energy from the muffler 500 and transmit the same to the heat radiating portion 620. The heat radiating portion 620 can transfer the thermal energy received from the contact-area increasing portion 610 to the oil.

Thus, the muffler 500 can have the increased temperature due to the refrigerant. The heat radiating member 600 can have the increased temperature due to the muffler 500. Further, the heat radiating member 600 can raise the temperature of the oil stored in the oil storage space S.

In other words, the thermal energy of the refrigerant can be conducted and transferred to the oil. Accordingly, each of the muffler 500 and the heat radiating member 600 can be made of a material having high thermal conductivity. For example, the material of each of the muffler 500 and the heat radiating member 600 can include aluminum (Al).

Figure 9:
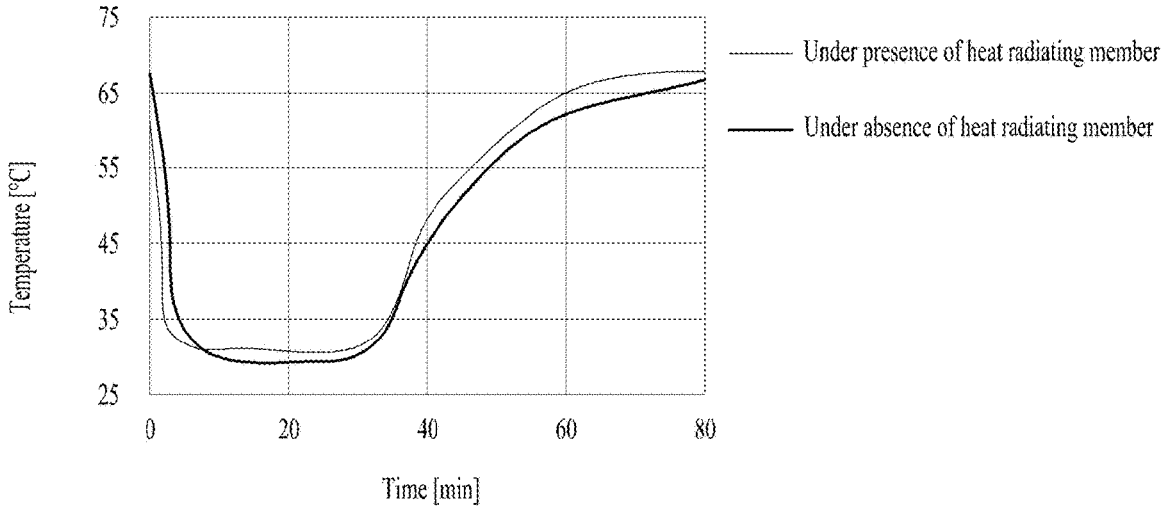
FIG. 9 is a graph of comparing results between an example lower scroll compressor including the heat radiating member and an example lower scroll compressor without the heat radiating member.

FIG. 9 is a graph of a comparing result between an example lower scroll compressor including the heat radiating member and an example lower scroll compressor without the heat radiating member.

Referring to FIG. 9, when the lower scroll compressor includes the heat radiating member 600, the temperature of the oil rises faster than the temperature of the oil rises when the lower scroll compressor does not include the heat radiating member 600.

Effects as not described herein can be derived from the above configurations. The relationship between the above-described components can allow a new effect not achieved in the conventional approach to be derived.

In addition, implementations shown in the drawings can be modified and implemented in other forms. The modifications should be regarded as falling within a scope of the present disclosure when the modifications is carried out so as to include a component claimed in the claims or within a scope of an equivalent thereto.

What is claimed is:

1. A compressor comprising:

a casing that defines an oil storage space configured to receive oil therein, the casing having an opening configured to discharge refrigerant to an outside of the casing;

a rotatable shaft disposed in the casing;

a driver coupled to an inner circumferential surface of the casing and configured to rotate the rotatable shaft;

a compression assembly that is coupled to the rotatable shaft and that compresses and discharges the refrigerant to an inside of the casing;

a muffler coupled to the compression assembly and configured to guide the refrigerant discharged from the compression assembly toward the opening, the muffler being configured to exchange heat with the refrigerant; and a heat radiating member coupled to the muffler, the heat radiating member extending to the oil storage space and contacting the oil in the oil storage space, wherein the muffler is configured to exchange heat with the oil through the heat radiating member, wherein the heat radiating member comprises:

a contact portion that is in contact with the muffler, and a heat radiating portion that extends from the contact portion to the oil storage space and contacts the oil in the oil storage space, and wherein the contact portion defines a first area in contact with the muffler and a second area connected to the heat radiating portion.

2. The compressor of claim 1, wherein the heat radiating member further comprises a fastener that couples the contact portion to the muffler.

3. The compressor of claim 2, wherein the muffler defines a muffler shaft receiving portion through which the rotatable shaft passes, and wherein a distance between the heat radiating portion and the muffler shaft receiving portion is less than a distance between the muffler shaft receiving portion and the fastener.

4. The compressor of claim 3, wherein the heat radiating portion has a tapered shape that extends toward the oil storage space and has a distal end located in the oil storage space.

5. The compressor of claim 1, wherein the second area is smaller than the first area.

6. The compressor of claim 3, wherein the contact portion extends in a radial direction of the rotatable shaft, the contact portion having:

a first end that is located away from the muffler shaft receiving portion in the radial direction of the rotatable shaft; and a second end that faces the muffler shaft receiving portion in the radial direction of the rotatable shaft, and wherein the heat radiating portion extends from the second end to the oil storage space.

7. The compressor of claim 1, wherein the heat radiating portion extends parallel to a longitudinal direction of the rotatable shaft.

8. The compressor of claim 1, wherein the heat radiating member is made of aluminum.

9. The compressor of claim 1, wherein the muffler defines a muffler shaft receiving portion through which the rotatable shaft passes, and wherein the heat radiating portion comprises:

a first heat radiating portion that is spaced apart from the muffler shaft receiving portion by a first spacing, the first heat radiating portion surrounding at least a portion of the muffler shaft receiving portion; and a second heat radiating portion that surrounds at least a portion of the muffler shaft receiving portion, the second heat radiating portion being spaced apart from the muffler shaft receiving portion by a second spacing that is larger than the first spacing.

10. The compressor of claim 9, wherein a first extension length of the first heat radiating portion toward the oil storage space is greater than a second extension of the second heat radiating portion toward the oil storage space.

11. The compressor of claim 9, wherein the heat radiating portion defines at least one communication opening configured to communicate an outside of the heat radiating portion and an inside of the heat radiating portion with each other.

12. The compressor of claim 9, wherein the first heat radiating portion defines a first communication opening configured to communicate an inside of the first heat radiating portion and an outside of the first heat radiating portion with each other, and wherein the second heat radiating portion defines a second communication opening configured to communicate an inside of the second heat radiating portion and an outside of the second heat radiating portion with each other.

13. The compressor of claim 12, wherein the first communication opening and the second communication opening face each other.

14. The compressor of claim 12, wherein the first communication opening faces the second heat radiating portion, and the second communication opening faces the first heat radiating portion.

15. The compressor of claim 9, wherein the contact portion comprises:

a first contact portion in contact with the first heat radiating portion;

a second contact portion in contact with the second heat radiating portion; and a third contact portion that extends between the first contact portion and the second contact portion.

16. The compressor of claim 15, wherein the contact portion further comprises a fourth contact portion that extends radially outward from the second contact portion.

17. The compressor of claim 9, wherein the second heat radiating portion surrounds at least a portion of the first heat radiating portion.

18. The compressor of claim 9, wherein the first heat radiating portion comprises a pair of first heat radiating portions that are spaced apart from each other in a circumferential direction and arranged outside the muffler shaft receiving portion in a radial direction, and wherein the second heat radiating portion comprises a pair of second heat radiating portions that are spaced apart from each other in the circumferential direction and arranged outside the pair of first heat radiating portions in the radial direction.

19. The compressor of claim 1, wherein the driver comprises a rotor coupled to the rotatable shaft and a stator coupled to the inner circumferential surface of the casing, wherein the compression assembly comprises a fixed scroll and an orbiting scroll, the orbiting scroll being configured to rotate relative to the fixed scroll, and wherein the driver and the compression assembly are arranged between the opening of the casing and the oil storage space along the rotatable shaft.

20. The compressor of claim 1, wherein the heat radiating member is disposed below the muffler and above the oil storage space, wherein the contact portion is coupled to a bottom surface of the muffler and spaced apart from the oil in the oil storage space, and wherein the heat radiating portion extends downward from the contact portion to the oil storage space to thereby contact the oil in the oil storage space.

* * * * *